United States Patent [19]

Edberg et al.

[11] Patent Number: 4,613,001

[45] Date of Patent: Sep. 23, 1986

[54] WEATHER PROTECTED OFFSHORE DRILLING RIG

[75] Inventors: Nils Edberg, Göteborg; Ivar Kores, Mölndal; Gottfrid Holmkvist, Västra Frölunda; Rickard Helmerson, Göteborg, all of Sweden

[73] Assignee: Gotaverken Arendal AB, Sweden

[21] Appl. No.: 639,990

[22] Filed: Aug. 13, 1984

[30] Foreign Application Priority Data

Sep. 21, 1983 [SE] Sweden ..... 8305080

[51] Int. Cl.[4] ..... E21B 19/14; E21B 15/00; B63B 35/44

[52] U.S. Cl. ..... 175/52; 175/5; 175/85

[58] Field of Search ..... 175/5, 7, 52, 85

[56] References Cited

U.S. PATENT DOCUMENTS

| | | | |
|---|---|---|---|
| 3,499,498 | 3/1970 | Bromell et al. | 175/52 |
| 3,749,162 | 7/1973 | Anders | 175/5 X |
| 4,067,453 | 1/1978 | Moller | 175/85 X |
| 4,081,087 | 3/1978 | Freeman, Sr. | 175/85 X |
| 4,129,221 | 12/1978 | Moller | 175/85 X |

FOREIGN PATENT DOCUMENTS 2110602 6/1983 United Kingdom .

OTHER PUBLICATIONS

Cranfield, John, "Mobile Rig Designed for Arctic Waters", Mar., 1976, *Ocean Industry*, pp. 77-79.

*Primary Examiner*—Stuart S. Levy
*Assistant Examiner*—Thomas R. Hannon
*Attorney, Agent, or Firm*—Wegner & Bretschneider

[57] ABSTRACT

In order to improve the working conditions for the staff on drilling rigs, the work area for handling of pipes and tubes is arranged on a main deck covered by a drill deck, which has openings closable by hatch cover panels. The derrick is enclosed in a cover, from which tunnels extend out over the drill deck and comprises lifting means for handling of pipes and tubes between the decks. The tunnels are connected to the cover of the derrick by way of raised enclosures permitting the swinging of pipes from a horizontal position in the tunnel to a vertical position in the derrick, and vice versa. There is a door, at least at one of the enclosures permitting handling of especially long objects, and basically the handling of pipes and tubes can be performed within areas fully protected from the weather.

4 Claims, 8 Drawing Figures

WEATHER PROTECTED OFFSHORE DRILLING RIG

BACKGROUND OF THE INVENTION

Drilling rigs operating in offshore oil fields are periodically exposed to environmental conditions, which to a high degree obstruct work. While drilling, new pipes must continously be added, and on the occations when the drillcrown must be changed all pipes in the drillstring must be pulled up and then reinstalled, when the new drill-crown has been fitted.

The various pipes used have about the same length, but several different diameters are required, because the diameter of the drill-hole varies from the first part, and then step-by-step gets smaller while the hole penetrates deeper.

For this operation casing tubes are used which protect the drill hole and remain therein, while the drill pipes may have to be removed and reinserted several times. Furthermore there is at least one marine riser line including a telescopic part, which is substantially thicker and longer than the drill pipes.

All these items require a large storage and handling area, which especially during winter and in arctic conditions means big difficulties during the moving of pipes between the storage area and the drill deck. For providing a weather-sheltered work area the work is performed upon two decks, wherein the upper deck comprises tunnels and a protecting enclosure around the derrick.

SUMMARY OF THE INVENTION

The invention concerns a drilling rig, where the work area comprises a main deck with a pipe storage space, and a drill deck located thereabove, and carrying, among other things, the derrick with the drilling equipment. The invention is characterized in that the work area, in order to provide weather protected spaces for the handling of the pipes, comprises closable openings in the drill deck for communication with pipe storage racks arranged on opposite sides of a centre line through the derrick and, in that a transport passage on said drill deck extends from the derrick and is located in a raised tunnel, which communicates with said underlying main deck, and is also connected to a protecting enclosure around said derrick, via a raised enclosure allowing pipes of the actual length to swing from a horizontal to a vertical position during transfer from the tunnel to the derrick.

The work area is preferably equipped with transport means for transferring the pipes vertically between the decks, and for horizontal transfer along both decks, wherein the transport means are arranged for handling of pipes, to, as well as away from the derrick. Adjacent to the vertical lifting means a bracket trolley is provided, which preferably is horizontally displaceable between the decks. The brackets comprise suspension means, which are adjustable in different angles of inclination.

Above the raised enclosure at the tunnel a door is preferably arranged in the protective enclosure of the derrick, which door permits the introduction of especially long components.

DETAILED DESCRIPTION

Figure 1:
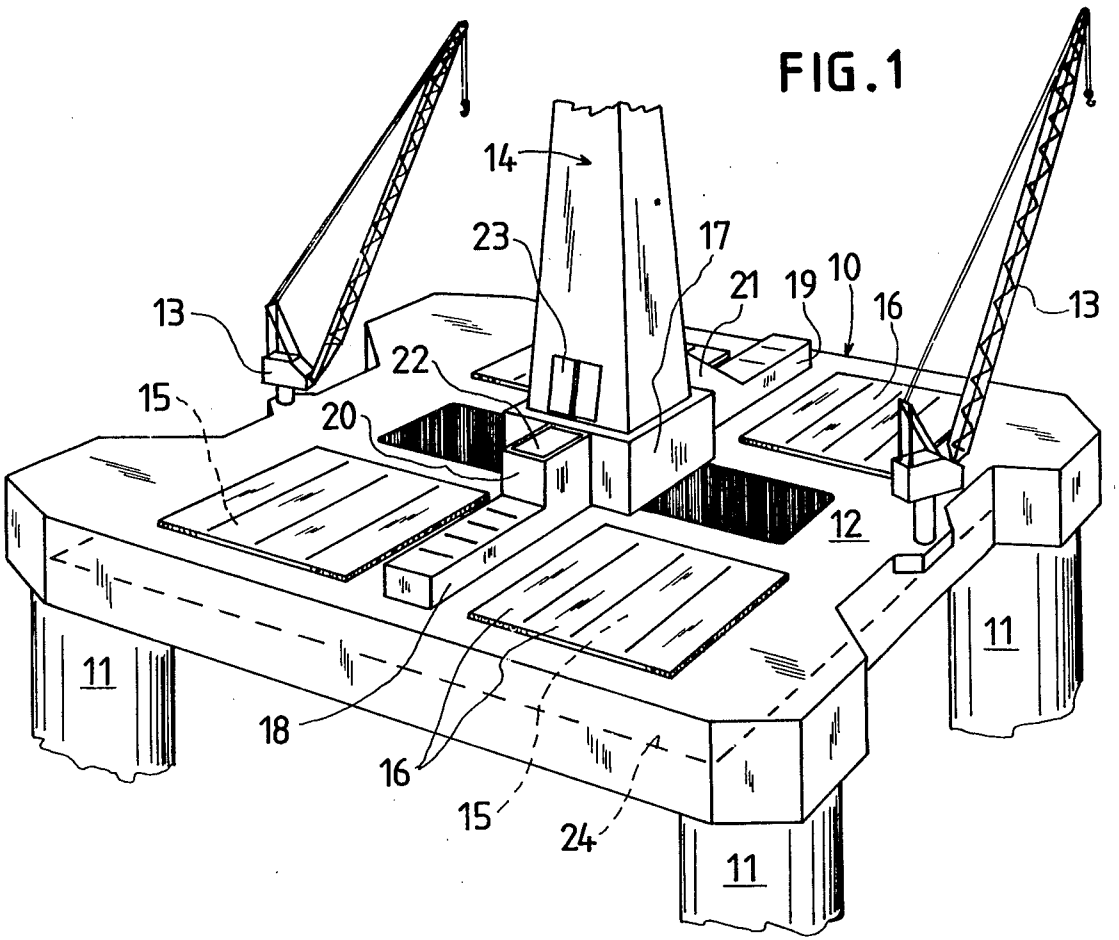
FIG. 1 diagrammatically shows the work deck of a semisubmersible drilling rig in a perspective view.

The drilling rig in the drawings is of the semi-submersible type, and can be transferred from one operational site to another. FIG. 1 shows very diagrammatically in a perspective view the rig, which comprises an operating platform 10, supported by four columns 11 standing on underwater pontoons (not shown in the drawings). As will be evident from the following description the operating platform is subdivided by several internal decks, of which a main deck contains the pipe storage racks, while an upper drill deck 12 carries two cranes 13, for the handling of pipes and supplies between supply ships and the operating platform, as well as a derrick 14 for handling of drilling equipment.

In the drill deck there are several openings to the underlying pipe storage racks, which are covered by hatches of the same kind as are used at cargo spaces in ships.

The derrick 14 is enclosed in a weatherprotecting cover 17, and in connection to this there are two closed tunnels 18 and 19, which cover openings in the drill floor, and are equipped with lifting means. Each tunnel 18, 19 terminates in a raised enclosure 20, 21, respectively, which makes it possible to swing a pipe of standard length within the weatherprotected space from horizontal position during displacing out of the tunnel, into vertical position in the derrick 14, and vice versa.

The space 21 in connection to the tunnel 19 is defined by an inclined roof, while the space 20 by the tunnel 18 has a level roof comprising a hatch 22. In the cover 17 of the derrick adjacent to the hatch 22, there is a sideways slideable door 23. The tunnel 18 is furthermore covered by dismountable hatch panels, and it is possible, in the manner indicated in broken lines to the right in FIG. 4, to handle even an extra long marine riser tube.

This operation is thus not fully covered, but it is seldom performed and satisfactory protection from the wind is provided.

The openings 16 are located in pairs to each side of a centre line through the derrick, and the underlying pipe storage is designed for a certain average number of pipes of the different dimensions in use.

Figure 2:
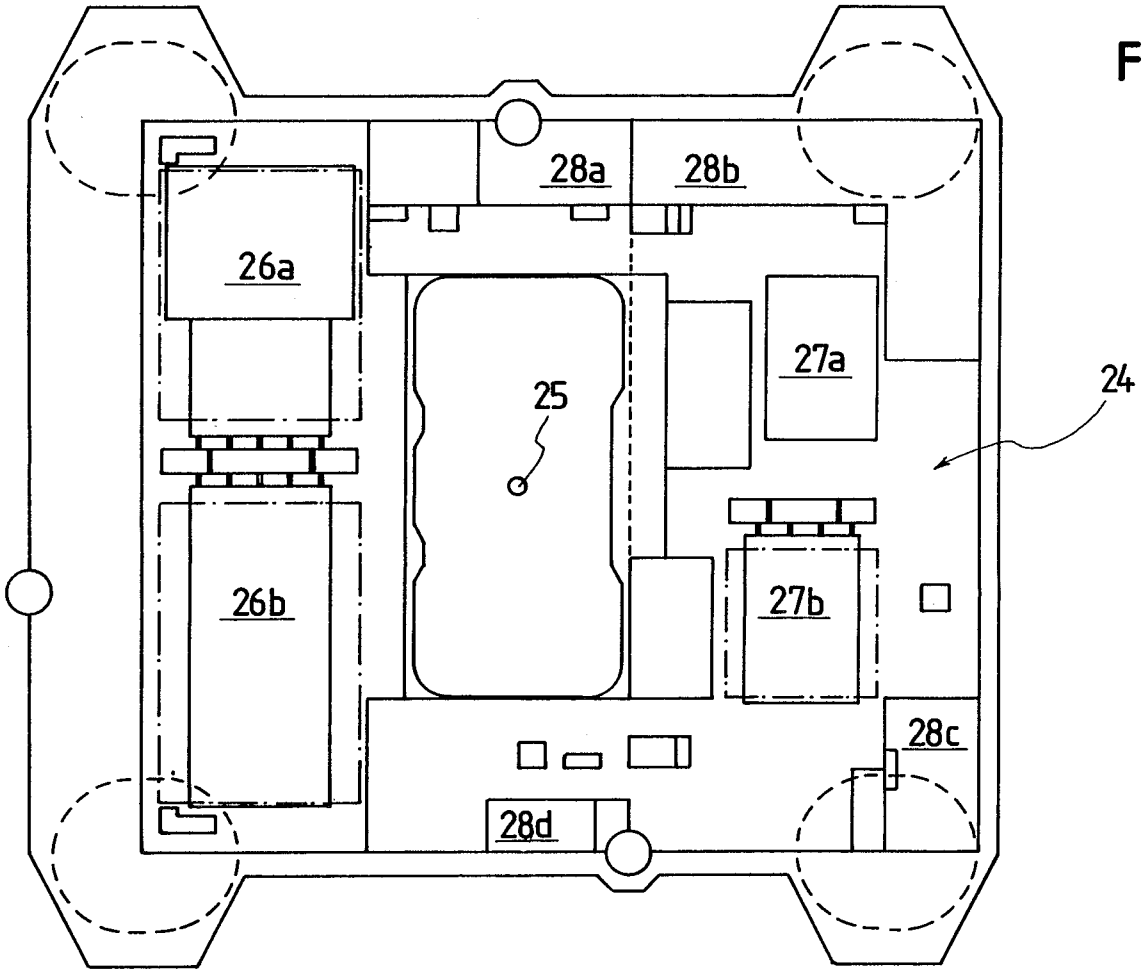
FIG. 2 shows the main deck in a simplified plane view.

FIG. 2 shows the main deck 24 in a plane view. The center of the derrick is marked with 25 and the pipe storage racks 26*a, b,* and 27*a, b* respectively, are located to each side of a centre line through the center 25 of the derrick. On this deck there are also a number of stores and work shops 28*a, b, c, d.*

As will be more clearly understood from the following figures there are transport means of known types for transferring the pipes and tubes between the storage racks and the lifting means in connection with the tunnels 18, 19.

Figure 3:
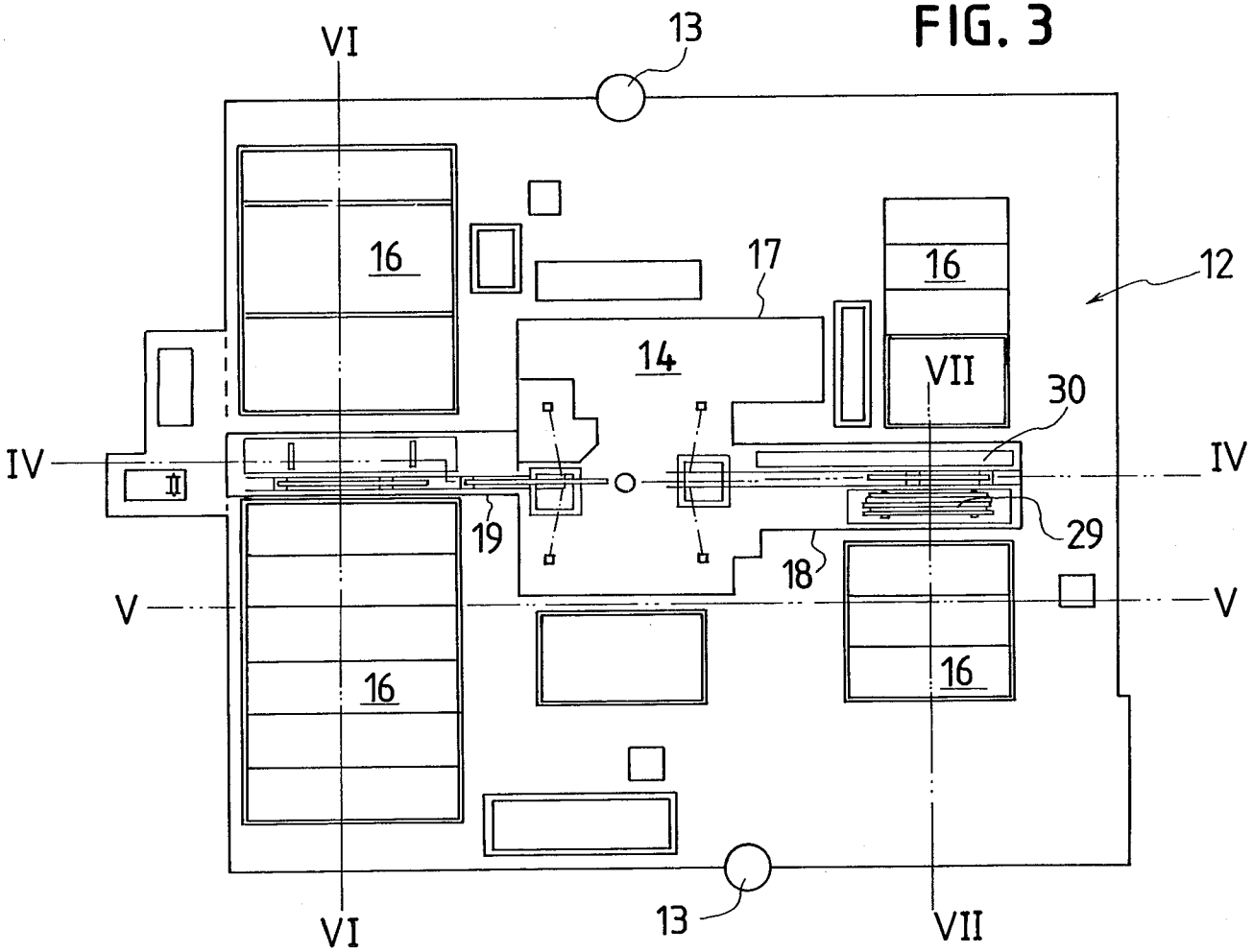
FIG. 3 shows the drill floor in a simplified plane view.

FIG. 3 shows the drill floor 12 in a plane view, where the corresponding reference numerals from FIG. 1 have been used. In the tunnel 18 are shown a number of pipes 29 of standard length, as well as the telescopic part of a marine riser line 30.

Figure 4:
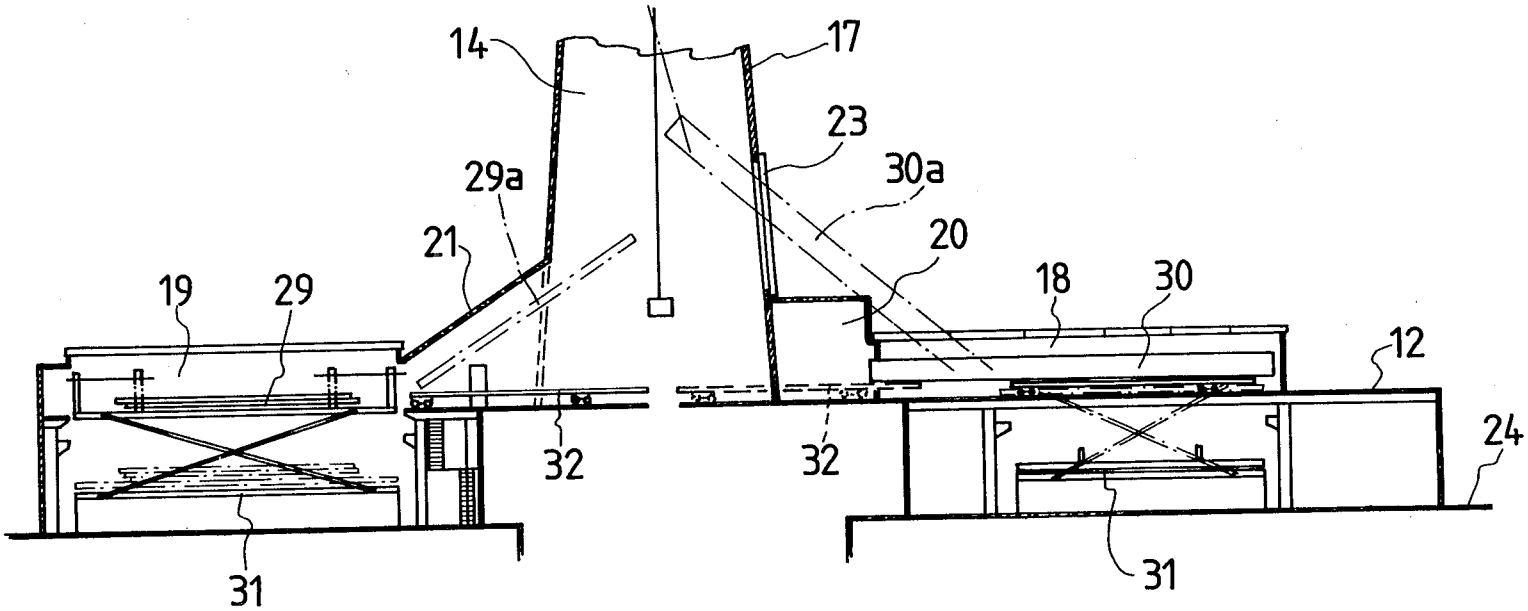
FIG. 4 is a longitudinal section along line IV—IV in FIG. 3.

FIG. 4 is a vertical section along the centre line through the center 25 of the derrick. In connection to the tunnels 18 and 19 there are lifting means 31, e.g. of the rising floor type, to move the pipes between the decks 24 and 12. There are also roller conveyors 32 in the extension of the lifting means, for the movement of pipes to the derrick. The tunnels are dimensioned to facilitate horizontal movement of the pipes.

As can be seen in the left side of the figure the inclined roof over the enclosure 21 facilitates the swinging of a pipe 29*a* to a vertical position within the derrick. The same applies to the space 20.

When swinging up a large tube piece 30*a* you have to open the door 23, the hatch 22 in the roof of the space 20 as well as one or more of the hatch panels covering the tunnel 18.

Figure 5:
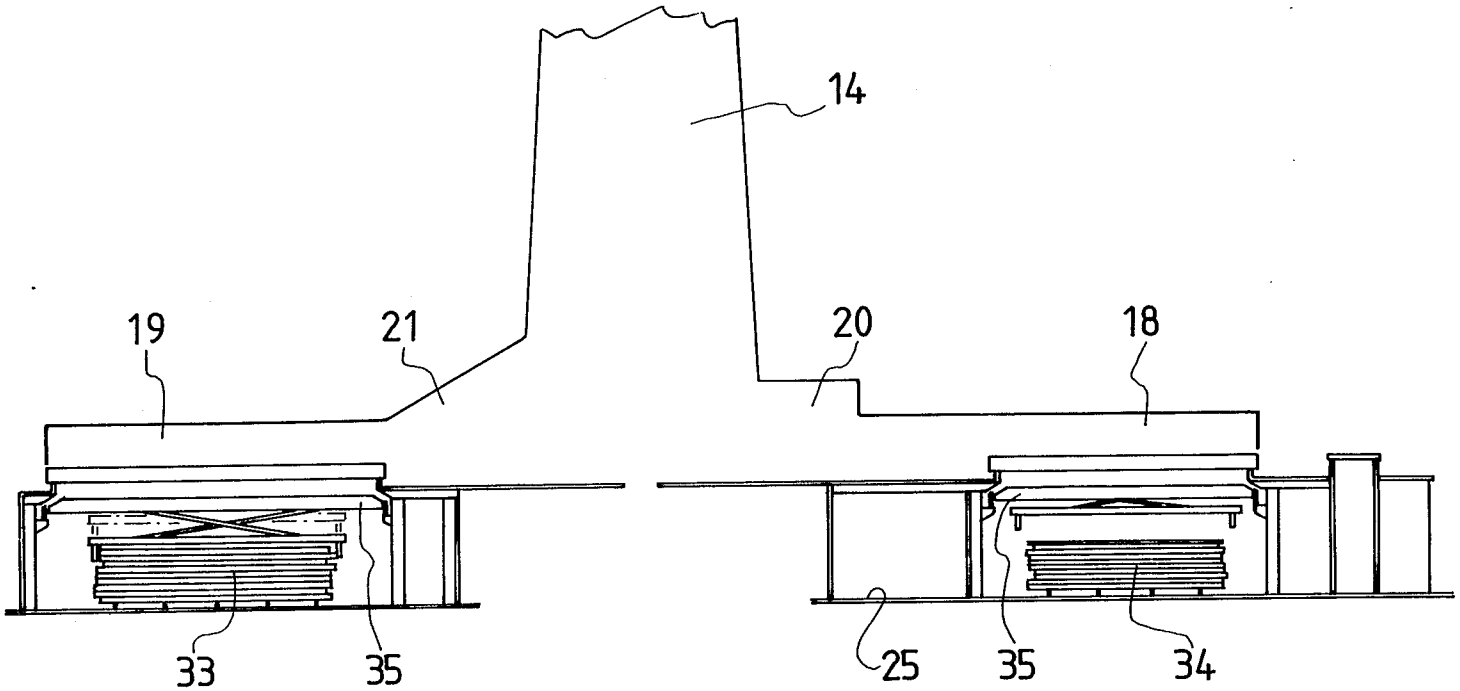
FIG. 5 is a longitudinal section along line V—V in FIG. 3.

FIG. 5 shows a vertical section, parallel with the center line through the pipe storage racks 33, 34. In these areas there are trolley runways 35 for horizontal transfer along the main deck 25, to and from the lifting means at the tunnels.

Figure 6:
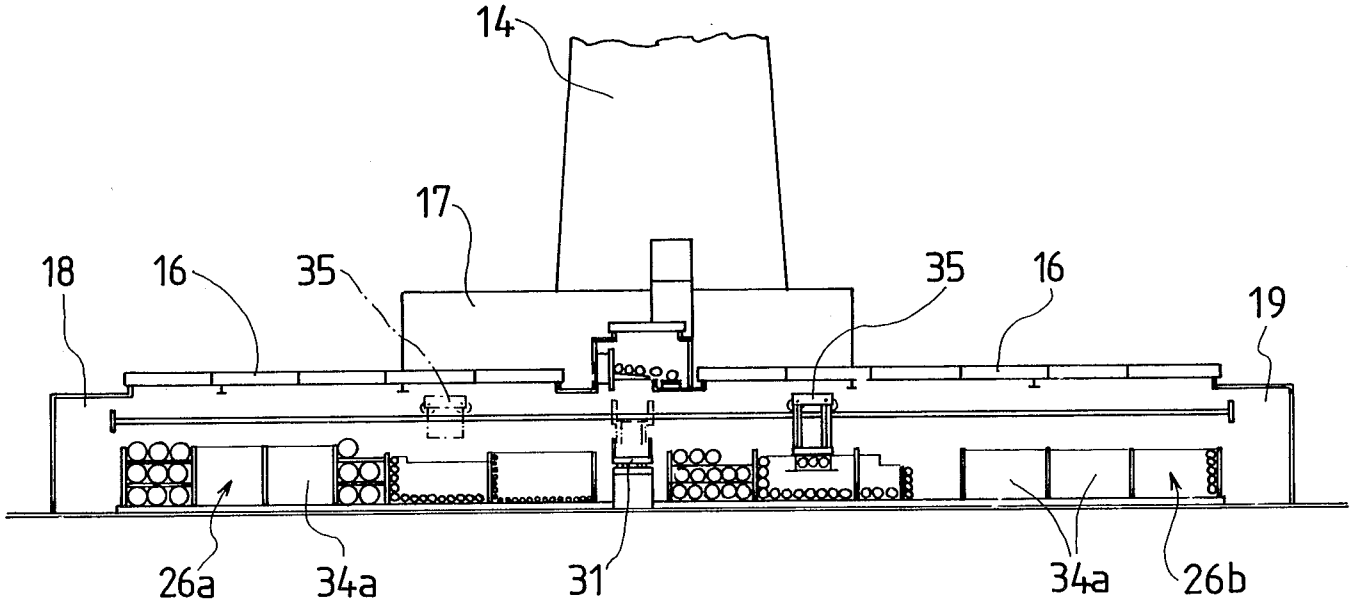
FIG. 6 is a cross-section along line VI—VI in FIG. 3.

FIG. 6 shows a vertical section through one pair of pipe storage racks 26*a, b* taken perpendicularly to the centre line, from which it will be evident that the storage racks are divided into compartments according to the estimated demand for pipes of certain dimension. The necessary number of hatch panels 16 are removed when loading pipes by means of the derricks 13 from a supply ship.

Figure 7:
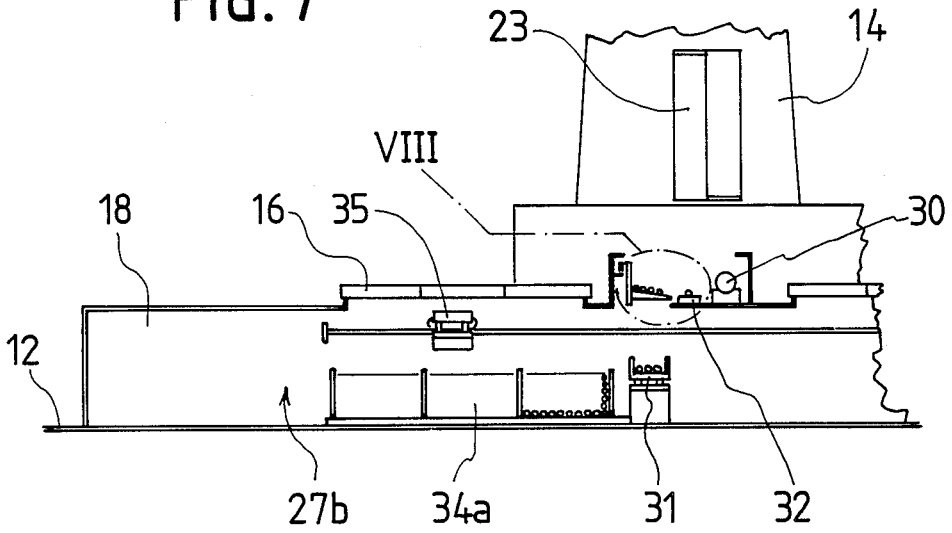
FIG. 7 is a cross-section along line VII—VII in FIG. 3, and FIG. 8 in a larger scale shows the encircled area VIII in FIG. 7.
Figure 8:
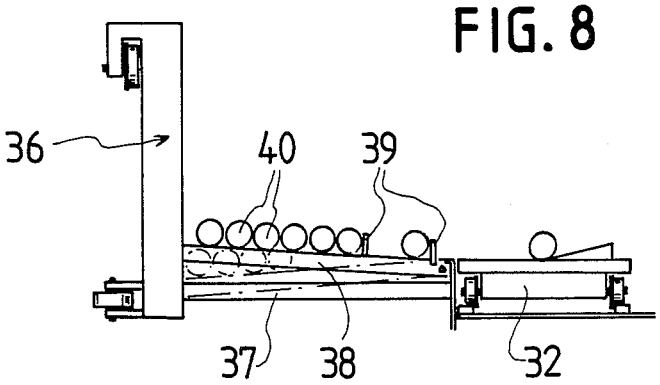

FIG. 7 shows a corresponding section through the tunnel 18. FIG. 8 shows encircled details in FIG. 7 on a larger scale, and illustrates the means for reversing of the flow of pipes A telescopic part of the marine riser line 30 is stored on the drill floor, at one side of the horizontal roller conveyor 32, and can easily be rolled over onto it.

The vertical lifting means 31, which simultaneously can handle several pipes, co-operates with a bracket trolley 36, which is horizontally displaceable within the tunnel. In use the trolley 36 is first moved away from the work area of the lifting means 31, which is then raised above the level of the trolley, the trolley is then returned below the lifting means 31, which, when lowered transfers the pipes onto the trolley 36.

The brackets 37 comprise suspension means 38, which by hydraulic actuators (not shown) can be swung so as to be inclined downwards or upwards in relation to the horizontal roller conveyor 32.

In the position shown in FIG. 8, pipes 40 are to be moved from the trolley 36 over to the roll conveyor 32. The suspension means are then inclined downwards in relation to the conveyor. Latching means 39 permit only one pipe 40 at a time to roll down towards the conveyor.

When the pipes are removed from the conveyor the suspension means are inclined away from the roll conveyor. The pipes will automatically roll over onto the trolley, when they have reached a position along the trolley, and a safety latch at the conveyor has been released.

Rising floors and trolley runways operate in arbitrary known ways in both directions.

The embodiment described above and illustrated in the drawings is merely one example of the invention, and the components thereof may be varied in different ways within the scope of the accompanying claims, and in view of the field of use, and the size of the rig. It is evident that the handling of pipes, tubes and lines comprises several operations spread over large areas, and it is of considerable value if the operations performed on the drill deck can be carried out under conditions well protected from the influence of the weather.

What I claim is:

1. A drilling rig comprising a main deck having pipe storage racks as well as a superposed drill deck mounting a derrick for the drilling equipment, closable openings in said drill deck for supplying pipes into said pipe racks, a protecting enclosure around said derrick, at least one transport passage on said drill deck, extending away from said enclosed derrick, and located in a raised tunnel structure, which communicates with said underlying main deck, and a raised enclosure adjacent to said enclosed derrick permitting pipes to be swung from a horizontal to a vertical position during transfer from said tunnel to said derrick, and transport means for the vertical displacement of pipes between said decks, as well as for horizontal displacement along both said decks.

2. A drilling rig according to claim 1, in which said transport means is arranged for handling of pipes to, as well as away from said derrick.

3. A drilling rig according to claim 1 further including a bracket trolley adjacent to said transport means, operating between said decks, said trolley being horizontally displaceable and its brackets comprising suspension means adjustable in different angles of inclination.

4. A drilling rig according to claim 1 further including a door in the protecting enclosure at said derrick arranged above said raised enclosure at said tunnel, as well as a removable cover for said raised enclosure for permitting the introduction of extra long objects.

* * * * *